US005139269A

United States Patent [19]

Peterson

[11] Patent Number: 5,139,269

[45] Date of Patent: Aug. 18, 1992

[54] FINANCIAL GAME APPARATUS

[76] Inventor: Robert N. Peterson, 13095 Lakeside Ave., Bear Lake, Mich. 49614

[21] Appl. No.: 800,123

[22] Filed: Nov. 29, 1991

[51] Int. Cl.[5] ..... A63F 3/00

[52] U.S. Cl. ..... 273/256; 273/287

[58] Field of Search ..... 273/241, 242, 243, 256, 273/278, 287

[56] References Cited

U.S. PATENT DOCUMENTS

| | | | |
|---|---|---|---|
| 3,198,521 | 8/1965 | Kramer et al. | 273/256 |
| 4,032,153 | 6/1977 | Daum | 273/256 |
| 4,378,942 | 4/1983 | Isaac | 273/278 |
| 4,431,195 | 2/1984 | Brand et al. | 273/256 |
| 4,538,816 | 9/1985 | Figueroa | 273/256 |
| 4,840,382 | 6/1989 | Rubin | 273/256 X |
| 4,934,707 | 6/1990 | Koster | 273/278 X |
| 4,948,145 | 8/1990 | Breslow | 273/256 |

FOREIGN PATENT DOCUMENTS

| | | | |
|---|---|---|---|
| 2594040 | 8/1987 | France | 273/256 |
| 8303823 | 6/1985 | Netherlands | 273/256 |

*Primary Examiner*—Theatrice Brown
*Assistant Examiner*—William E. Stoll
*Attorney, Agent, or Firm*—Hugh E. Smith & Assoc.

[57] ABSTRACT

A financial game includes a circuitous path, including various bonus and penalty spaces directed therethrough, with each of the game path spaces of the circuitous path arranged in association with a company and associated stock, wherein individuals decide to either buy or not buy certain stocks, wherein various penalty and bonus spaces direct a player to a penalty or bonus card to indicate a rise or fall of prices of stocks purchased, wherein a player to obtain a predetermined simulated dollar amount is declared a winner.

5 Claims, 8 Drawing Sheets

Fig 6A

Fig 6B

Fig 6

21

Fig 6A

BUY,SELL,& PROFIT - STOCK MARKET

| | Market | Shares | Principle Bus, | Ranges | Cur. | Div. |
|---|---|---|---|---|---|---|
| Advance Home | AMER | 750.00 | Real Estate | $7.00- 1.50 | 3.00 | 1.00 |
| American Video | O-T-C | 45.00 | Video Supplies | $5.50- 2.00 | 2.00 | 0.50 |
| Applied Secur. | O-T-C | 125.00 | Savings&Loans | $6.00- 1.50 | 2.00 | 0.50 |
| Base Security | AMER | 553.00 | Bank Holding | 15.50- 5.00 | 9.00 | 4.00 |
| Biotron | O-T-C | 45.00 | HighTech Med. | $3.00- 0.50 | 1.00 | 0.00 |
| Brandy Bay | O-T-C | 1,255.00 | Oil & Gas Pro. | 23.50- 8.00 | 17.00 | 2.00 |
| Cannon Mines | N.Y. | 890.00 | Gold Prod. | 91.00- 7.50 | 18.00 | 4.00 |
| Home Clear | AMER | 54.00 | Home Supplies | 12.00- 7.00 | 7.00 | 1.00 |
| Clear Inc. | AMER | 235.00 | Medical Equip. | 45.00-14.00 | 17.00 | 3.00 |
| Crazey Network | O-T-C | 750.00 | Cable T.V. | 12.00- 3.00 | 3.00 | 1.50 |
| Crazey Oil | N.Y. | 84.00 | Oil Drilling | 25.00-14.00 | 14.00 | 2.00 |
| Data Tech. | AMER | 125.00 | Electronic Ind. | 12.00- 7.00 | 7.00 | 1.00 |
| Easy Living | O-T-C | 345.00 | Leisure Equip. | 18.50- 4.50 | 6.00 | 1.00 |
| Energy Group | AMER | 42.00 | Nat. Gas Prod. | 30.00-15.00 | 24.00 | 3.00 |
| First Group | N.Y. | 150.00 | Ins. Home/Farm | 25.50- 8.00 | 12.00 | 2.00 |
| First Test | AMER | 1,500.00 | Generic Drugs | 18.50- 5.00 | 8.00 | 1.00 |
| Hammon Oil | O-T-C | 455.00 | Oil Drilling | 7.00- 2.00 | 3.00 | 2.00 |
| JBC | O-T-C | 55.00 | Radio Broadcast | 17.50- 4.50 | 6.00 | 2.00 |
| Life Store | N.Y. | 75.00 | Ins. Life/Auto | 45.00-20.00 | 25.00 | 3.00 |
| Lucky Oil | N.Y. | 127.00 | Oil Refining | 9.50- 2.00 | 4.00 | 1.00 |
| Mass Inc. | AMER | 25.00 | Hospital Nurses | 20.00- 8.50 | 15.00 | 2.00 |

| | | | | | | | |
|---|---|---|---|---|---|---|---|
| Metro System | O-T-C | 900.00 | Electronic Ind. | 10.50- | 2.50 | 4.00 | 1.00 |
| Network Air | AMER | 355.00 | Comp. Commun | 15.00- | 6.00 | 6.00 | 2.00 |
| Nuclear System | O-T-C | 1,050.00 | Medic. Supplies | 7.00- | 2.00 | 4.00 | 1.00 |
| Odyssey System | O-T-C | 65.00 | Home Security | 18.50- | 4.00 | 7.00 | 2.00 |
| Par Tech | N.Y. | 125.00 | Sports Equip. | 23.50- | 3.50 | 8.00 | 3.50 |
| Price Best | O-T-C | 850.00 | Gold Mining | 12.50- | 2.50 | 4.00 | 1.00 |
| Real Care | O-T-C | 250.00 | Home Care Nur. | 7.50- | 1.50 | 3.00 | 0.00 |
| Republic | AMER | 700.00 | Land Develop | 36.00- | 13.00 | 20.00 | 3.50 |
| Resort System | AMER | 95.00 | Resorts/Equip. | 22.00- | 9.50 | 13.00 | 2.00 |
| Sea Rock | N.Y. | 210.00 | Pollution Cont. | 28.50- | 7.00 | 10.00 | 3.00 |
| Shell System | N.Y. | 175.00 | Ocean Harvests | 18.00- | 4.00 | 7.00 | 1.50 |
| Silcon Group | O-T-C | 450.00 | Computers | 15.00- | 5.00 | 9.00 | 2.00 |
| Software Inc. | N.Y. | 90.00 | Comp. Software | 55.00- | 13.00 | 20.00 | 2.00 |
| Special Tech | O-T-C | 45.00 | Electronic Def. | 34.50- | 8.00 | 15.00 | 5.00 |
| Sports Tech | N.Y. | 125.00 | Sports Equip. | 25.00- | 10.00 | 18.00 | 2.00 |
| Sure Strike | AMER | 240.00 | Gold Mining | 18.00- | 2.00 | 6.00 | 1.50 |
| Team Corp | AMER | 1,552.00 | Out-Let Stores | 18.00- | 2.00 | 4.00 | 1.00 |
| Tele-a-Probe | AMER | 845.00 | Comp. Supplies | 35.00- | 12.00 | 16.00 | 4.00 |
| Today's Toys | N.Y. | 350.00 | HighTech Equip. | 25.00- | 8.00 | 12.00 | 2.00 |
| Union Group | AMER | 95.00 | Hospital Care | 19.50- | 5.00 | 8.00 | 1.00 |
| Union Indust. | O-T-C | 125.00 | Sports Clothes | 12.50- | 2.50 | 5.00 | 2.00 |
| United Group | N.Y. | 345.00 | Home Supplies | 28.50- | 12.00 | 15.00 | 3.00 |
| Up Town | N.Y. | 650.00 | Mall Construct. | 19.00- | 8.00 | 10.00 | 2.00 |
| Valley Labs | O-T-C | 650.00 | Test New Drugs | 21.00- | 4.00 | 7.00 | 2.00 |
| Visa Care | O-T-C | 250.00 | Eye Care Prod. | 12.50- | 2.50 | 5.00 | 1.00 |

21

Fig 6B

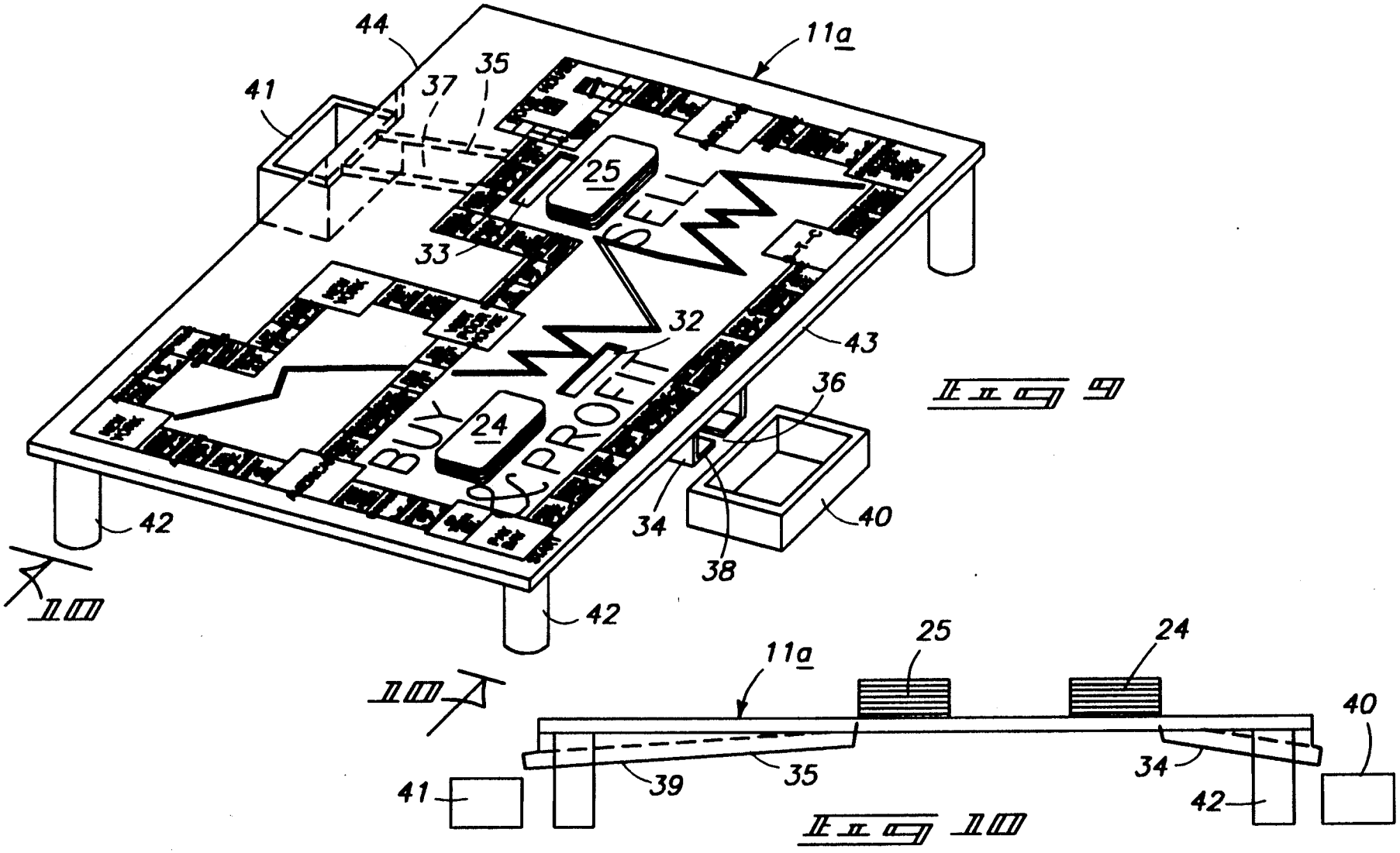
11a
43
40
36
38
34
32
42
25
24
35
37
44
41
33
39
II
III

FINANCIAL GAME APPARATUS

BACKGROUND OF THE INVENTION

1. Field of the Invention

The field of invention relates to game apparatus, and more particularly pertains to a new and improved financial game apparatus wherein the same is directed for the entertainment and education of individuals regarding stock purchases and associated pitfalls therewith.

2. Description of the Prior Art

Game apparatus of various types are utilized throughout the prior art, wherein stock market games for the entertainment of individuals in association with stock market type stocks has been presented in the prior art. Such examples are present in U.S. Pat. No. 4,934,707 to Koster; U.S. Pat. No. 4,431,195 to Brand, et al.; U.S. Pat. No. 4,002,342 to Biggs; and U.S. Pat. No. 3,770,277 to Cass.

Accordingly, the instant invention overcomes deficiencies of the prior art by providing a game effecting greater simulation of stock market perils and events and as such, it is believed that the financial game apparatus of the instant invention substantially fulfills the need in directing individuals to amusement and education regarding stock market play.

SUMMARY OF THE INVENTION

In view of the foregoing disadvantages inherent in the known types of financial game apparatus now present in the prior art, the present invention provides a financial game apparatus wherein the same is arranged to direct people to understand and appreciate stock market interplay. As such, the general purpose of the present invention, which will be described subsequently in greater detail, is to provide a new and improved financial game apparatus which has all the advantages of the prior art financial game apparatus and none of the disadvantages.

To attain this, the present invention provides a financial game including a circuitous path, including various bonus and penalty spaces directed therethrough, with each of the game path spaces of the circuitous path arranged in association with a company and associated stock, wherein individuals decide to either buy or not buy certain stocks, wherein various penalty and bonus spaces direct a player to a penalty or bonus card to indicate a rise or fall of prices of stocks purchased, wherein a player to obtain a predetermined simulated dollar amount is declared a winner.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved financial game apparatus which has all the advantages of the prior art financial game apparatus and none of the disadvantages.

It is another object of the present invention to provide a new and improved financial game apparatus which may be easily and efficiently manufactured and marketed.

It is a further object of the present invention to provide a new and improved financial game apparatus which is of a durable and reliable construction.

An even further object of the present invention is to provide a new and improved financial game apparatus which is susceptible of a low cost of manufacture with regard to both materials and labor, and which accordingly is then susceptible of low prices of sale to the consuming public, thereby making such financial game apparatus economically available to the buying public.

Still yet another object of the present invention is to provide a new and improved financial game apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is an orthographic top view of a stock list utilized in play of the game of the invention.

FIG. 9 is an isometric illustration of a modified game board of the invention.

FIG. 10 is an orthographic view, taken along the lines 10—10 of FIG. 9 in the direction indicated by the arrows.

DESCRIPTION OF THE PREFERRED EMBODIMENT

Figure 1:
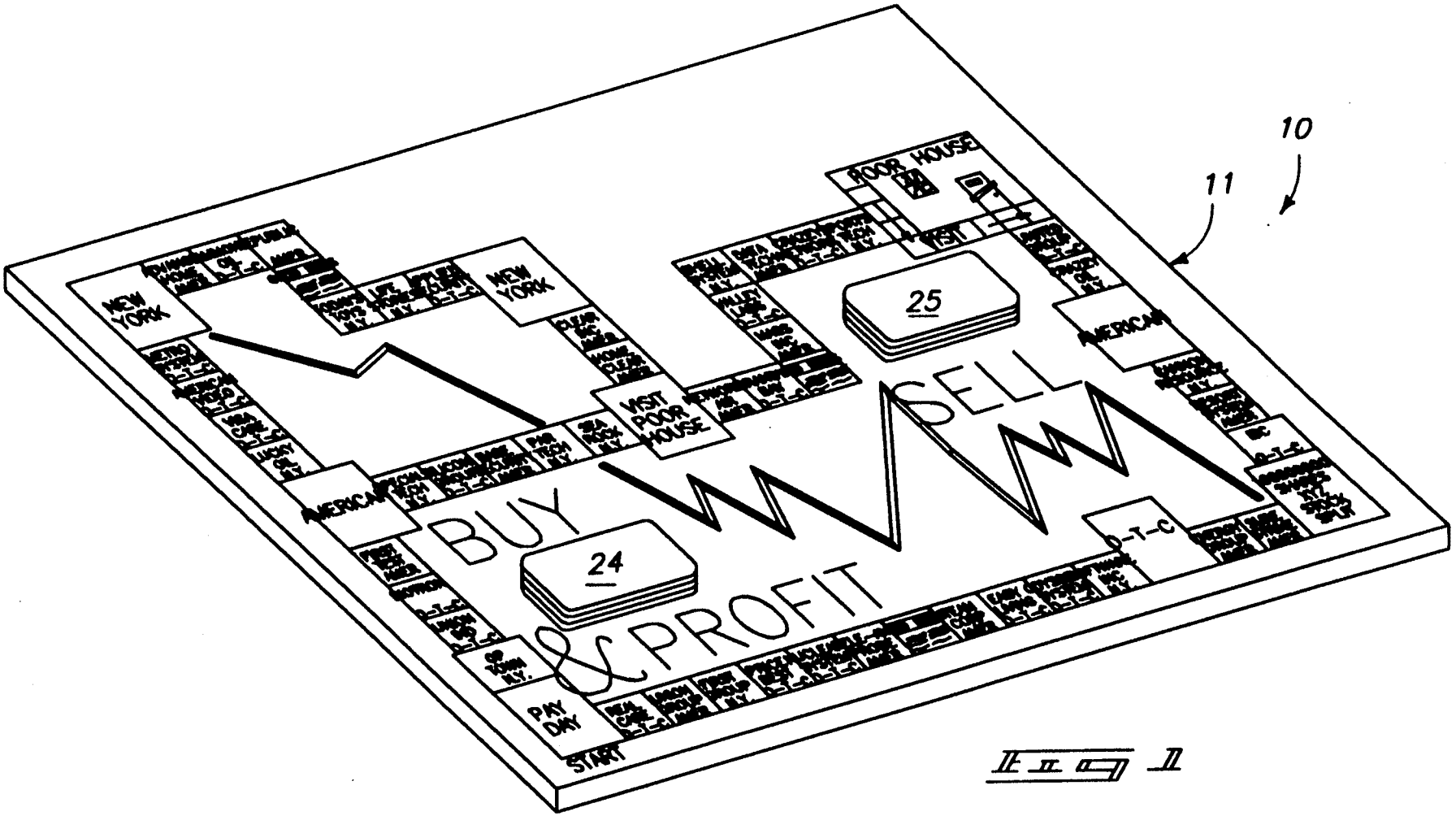
FIG. 1 is an isometric illustration of the board structure of the invention.
Figure 4:
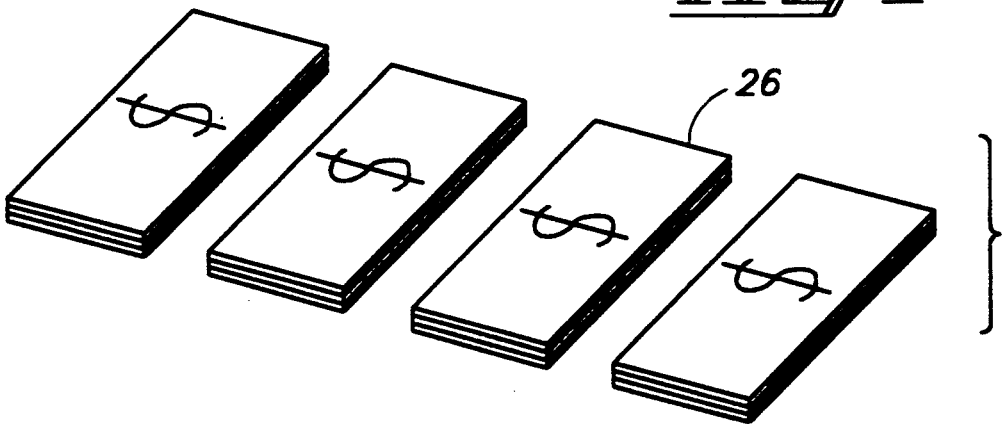
FIG. 4 is an isometric illustration of various denominations of money utilized in play of the game.

With reference now to the drawings, and in particular to FIGS. 1 to 10 thereof, a new and improved financial game apparatus embodying the principles and concepts of the present invention and generally designated by the reference numeral 10 will be described.

More specifically the financial game apparatus 10 of the instant invention essentially comprises a game board 11, including a circuitous game path 15 formed of path spaces 14, each space associated with a predetermined company of a stock list 21, as illustrated in FIG. 6. The stock list illustrates various price denominations and ranges in value of a stock versus a current value and a dividend paid by each stock. Purchase of the stock relative to its current value and the range of value of the stock provides for an individual to analyze whether to purchase or not purchase an associated stock. The game board top surface 12 contains the circuitous game path 15, with starting space 13 defining a "pay day" for initiation of play, wherein an individual begins play on the starting space 13 and is provided with a predetermined initial quantity of dollars, such as $50,000.00 for example, and wherein each player receives $10,000.00 or any arbitrary sum when that player passes pay day on subsequent turns. Players proceed along the path 15 by a roll of one dice on each turn, and they move the spaces rolled. At the time of landing upon a space 14, that player may purchase the amount of shares they want to of that stock or company if desired, and preferably an even number of shares such as 1,000 shares. The player must then calculate money spent and the like. Arbitrary sums are afforded each share, wherein a New York Stock Exchange designated stock is $100.00 per share, an American Stock is $10.00 per share, and an O.T.C. Stock is $1.00 per share.

A player upon landing upon an associated plurality of first bonus spaces 17, a second bonus plurality of spaces 18, or a third plurality of bonus spaces 19 with reference to the associated New York, American, and O.T.C. Stock Exchanges, that player will receive a quantity of money equal to the value of all shares that player holds of stock in that particular exchange. For example should a player have 100 shares of a New York Stock that player receives 100 shares times $100.00 per share or $1,000.00 for the value of that stock or stocks.

Figure 2:
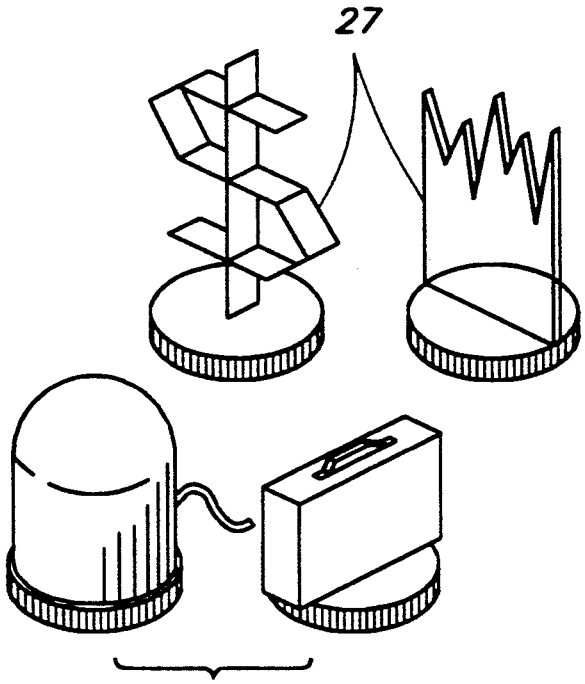
FIG. 2 is an isometric illustration of tokens utilized by the invention.
Figure 3:
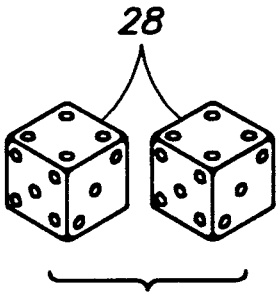
FIG. 3 is an isometric illustration of dice members utilized by the invention.
Figure 5:
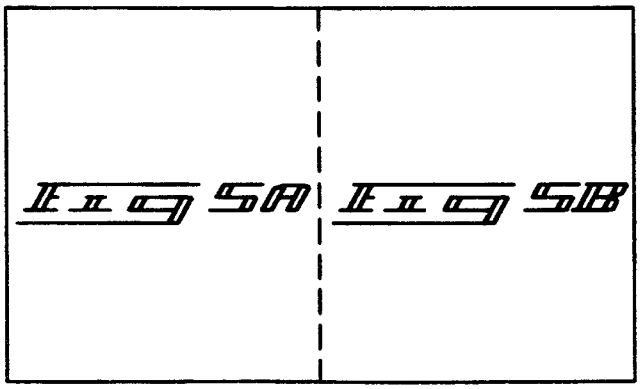
FIG. 5 is an orthographic top view of the game board of the invention.
Figure 5A:
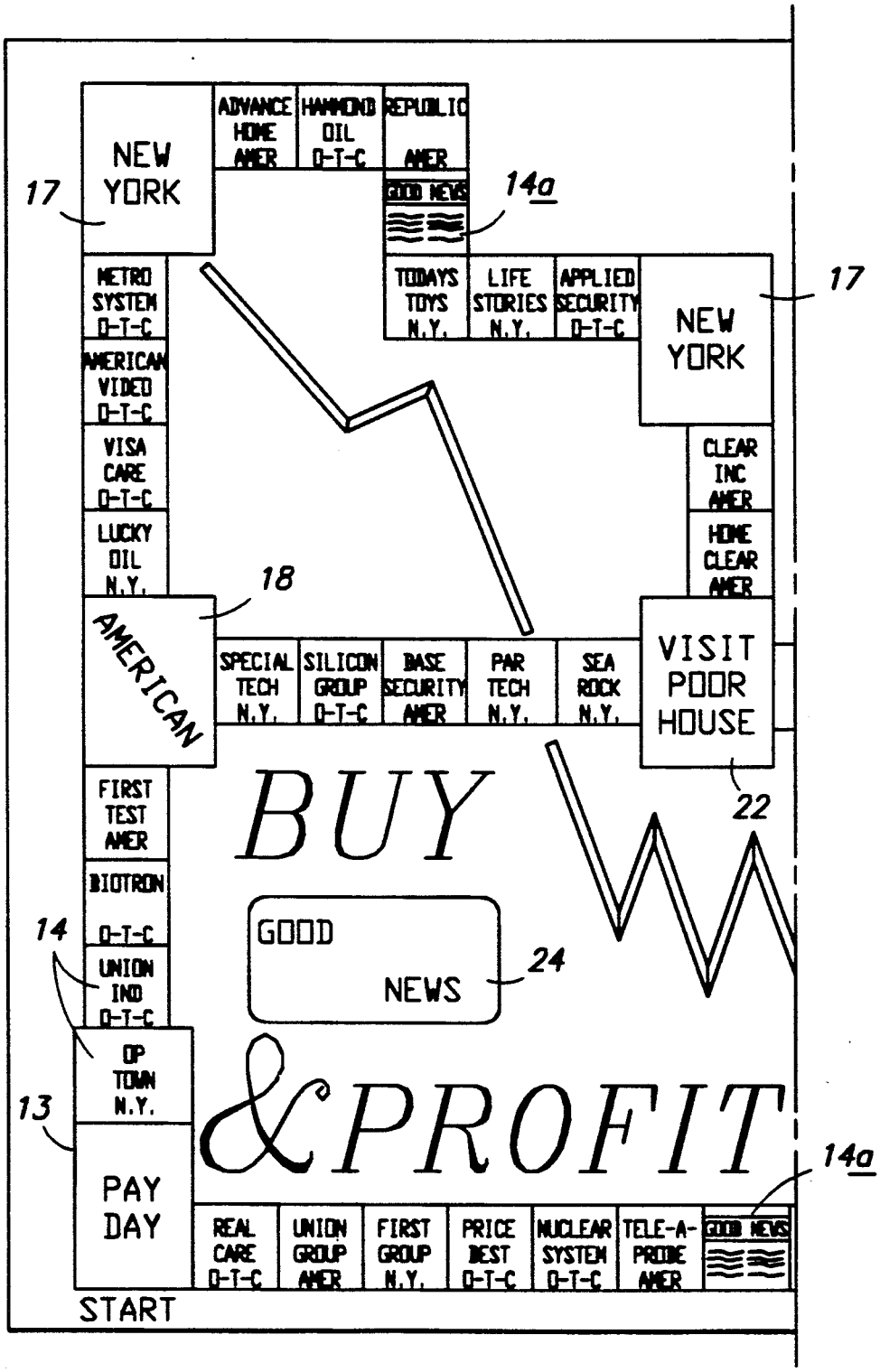
Figure 5B:
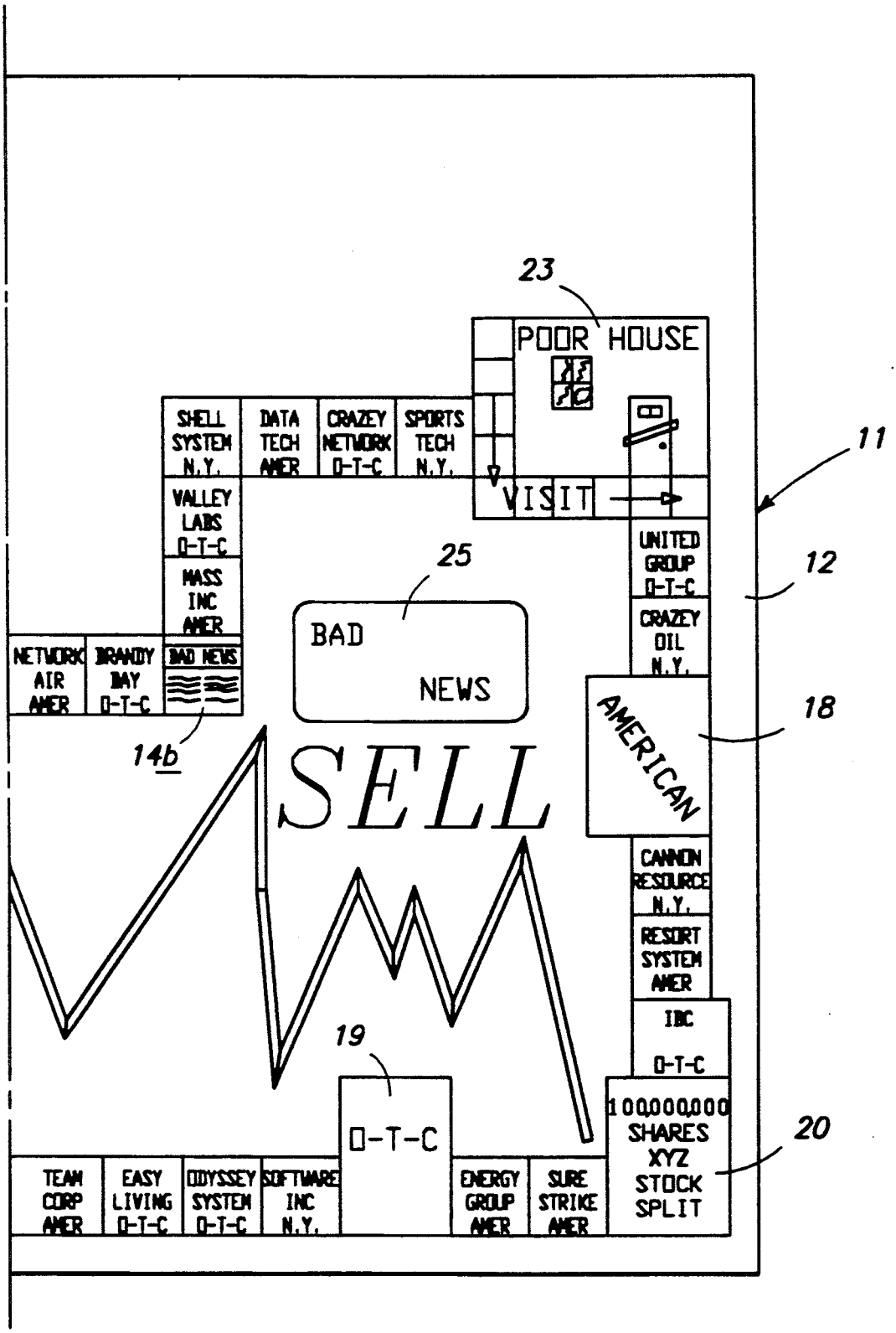

A stock split space 20 is provided wherein a player landing upon a stock split space must then roll one dice, wherein an even obtaining of a number, such as 2, 4, or 6, effects a two-for-one, four-for-one, or six-for-one respectfully split of the stock to improve that player's holding of that stock by that multiplicity. A throw of an odd number, such as one, three, or five, indicates a reverse split, wherein the stock holdings are divided by that amount. A penalty advance space 22 indicates advancing to a penalty space 23 to indicate a "poor house", wherein a player upon entering the poor house has two turns to leave free by rolling even numbers of a dice member 28 three times in a row. Should a player not obtain that consequence of dice throw, the player must pay half of all monies held or half of all stock shares held into the bank portion of the game. With reference to FIG. 2, arbitrary tokens of various configurations are afforded each player, wherein the tokens 27 may be of any configurational construction. The circuitous game path 15 and the associated path spaces 14 further include bonus card directing spaces 14*a* and at least one penalty card directing space 14*b* to direct players upon landing on such a space to the bonus and penalty cards 24 and 25 respectively. The penalty and bonus cards are designated as "good news" and "bad news" set forth in information causing a rise in a player's holding of a stock or information regarding a decline a player's holding of a stock respectively. The game board as illustrated in the FIGS. 9 and 10 illustrates that the game board top surface 12 containing the circuitous path 15 is defined by a game board bottom surface that is spaced above an underlying support surface by associated support legs 42 that are of a predetermined length. A respective first and second opening slot 32 and 33 positioned adjacent the bonus and penalty cards 24 and 25 respectively, wherein the first and second slots are in communication with respective first and second chute 34 and 35 respectively that is positioned in contiguous communication to the game board bottom surface projecting to respective first and second game board side walls 43 and 44. Each respective first and second chute includes respective first and second chute bottom wall slot 36 and 37 defined within a respective first and second chute bottom wall 38 and 39. The bottom walls 38 and 39 are spaced from the game board bottom surface a predetermined height substantially equal to a predetermined thickness of the cards 24 and 25. The predetermined height is less than the predetermined length of the support legs 42 to space the chutes above associated first and second containers 40 and 41 to receive the cards in a complementary manner and thereby insure that only one card is used and not reused during game play. If required, the cards may be, when accumulated within the associated containers 40 and 41, shuffled and repositioned on the game board top surface 12.

Figure 7:
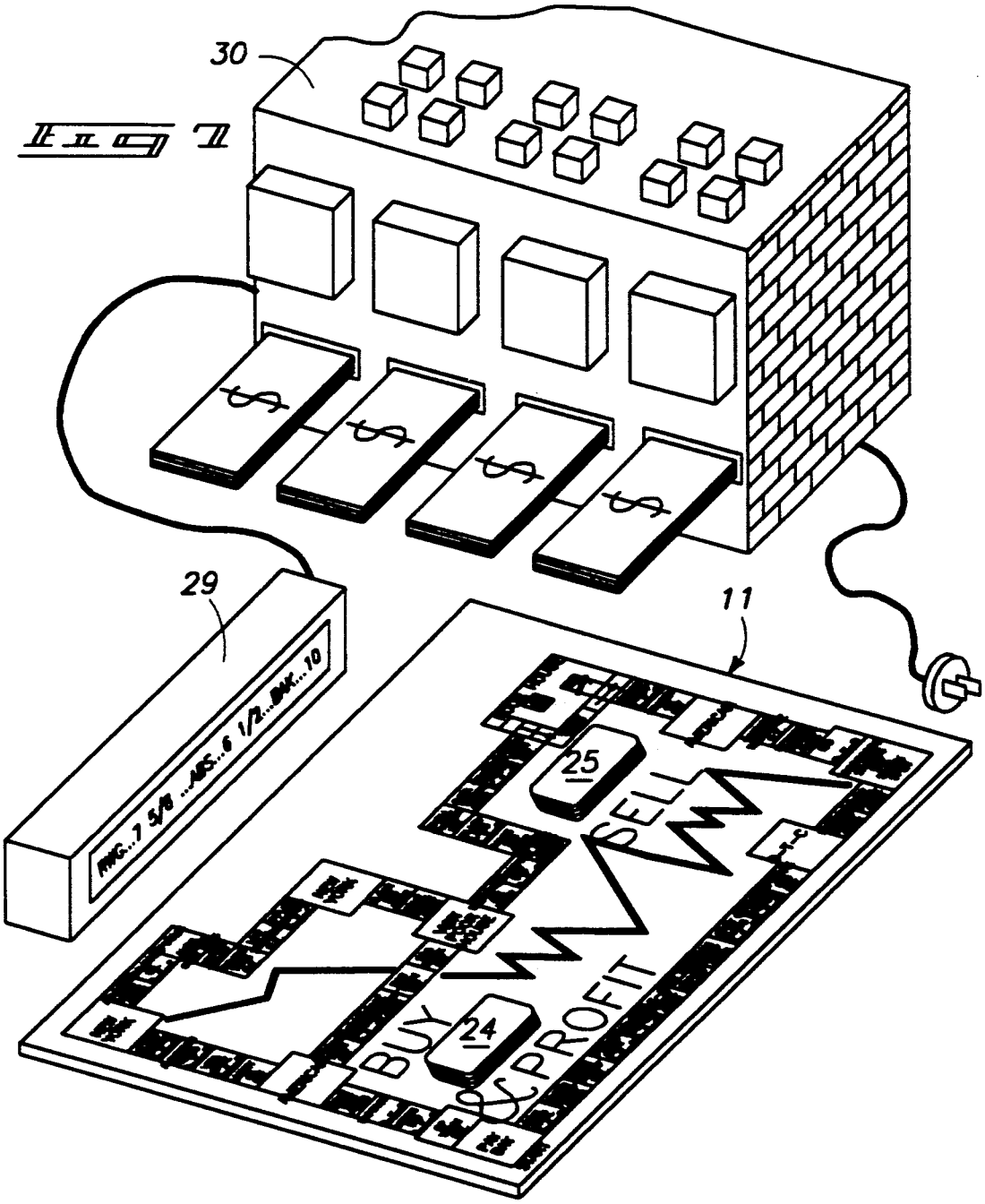
FIG. 7 is an isometric illustration of the invention utilizing electronically controlled data read-out.
Figure 8:
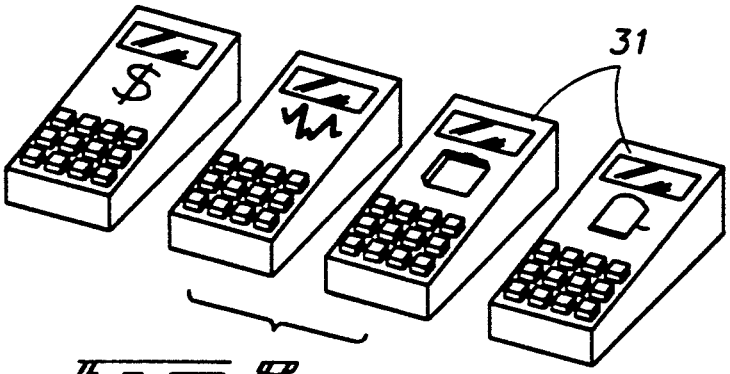
FIG. 8 is an isometric illustration of calculators afforded each player.

The FIGS. 7 and 8 illustrate that the game is adaptable to electronic control, such as electronic list display 29 cooperating with an electronic controller 30 to effect illustration of various values of the stocks per the listing of FIG. 6. The FIG. 6 is a partial listing where it is understood that the names and values of the stocks are subject to change and provide for a single stock in association with a single space 14. Further, the FIG. 8 illustrates that a calculator 31 may be provided each player to enhance ease of play of the game in use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A financial game apparatus, comprising, a game board, the game board including a game board top surface and a game board bottom surface, and including a game board first side wall spaced from a game board second side wall, and the game board top surface including a circuitous game path formed thereon, wherein the circuitous game path includes a plurality of path spaces, and a stock list, each stock list including a plurality of simulated stocks thereon, wherein each of the simulated stocks is arranged in association with one of said path spaces, and the circuitous game path further including a starting space, and a plurality of first bonus spaces associated with a first stock exchange, a plurality of second bonus spaces associated with a second stock exchange, and at least one third bonus space associated with a third stock exchange, and a stock-split space, and at least one dice member, wherein the stock-split space and the dice member direct a player to receive or lose stock value based upon a respective even or odd throw of the at least one dice member, and at least one penalty space, wherein the penalty space is operative to effect money by a player directed into the penalty space, and a plurality of bonus cards, and a plurality of penalty cards, and at least one bonus card directing space to direct a player to select a bonus card, and at least one penalty card directing space to direct a player to select a penalty card, wherein the bonus cards direct an escalation of value of a player's holdings, and the penalty cards direct a loss of value of the player's holding, wherein the bonus card directing space and the penalty card directing space are contained within a circuitous game path.

2. An apparatus as set forth in claim 1 including a first slot directed through the game board extending from the game board top surface through the game board bottom surface, and a first chute positioned below the first slot directed from the first slot to the first side wall, and a second chute positioned below the second slot, wherein the second chute is directed from the second slot to the game board second side wall, and a first container positioned below the first chute adjacent the first side wall, and a second container positioned below the second chute adjacent the second side wall.

3. An apparatus as set forth in claim 2 wherein the first chute includes a first chute bottom wall, and the second chute includes a second chute bottom wall, wherein a predetermined height is defined between the first chute bottom wall and the game board bottom surface, and wherein the predetermined height is defined between the second chute bottom wall and the game board bottom surface, and each bonus card and penalty card is defined by a predetermined thickness substantially equal to the predetermined height.

4. An apparatus as set forth in claim 3 wherein a plurality of support legs are fixedly and orthogonally mounted to the game board bottom surface, wherein each of the support legs are defined by a predetermined length greater than the predetermined height to position the first chute and the second chute above the first container and the second container respectively.

5. An apparatus as set forth in claim 4 wherein the first chute bottom wall includes a first bottom wall slot, and the second chute bottom wall includes a second chute bottom wall slot, wherein the first slot and the second slot are positioned longitudinally and medially of the first chute bottom wall and the second chute bottom wall respectively to permit ease of manual displacement of a respective bonus card and penalty card within the respective first chute and second chute.

* * * * *